US011749921B2

(12) United States Patent
Chen et al.

(10) Patent No.: US 11,749,921 B2
(45) Date of Patent: Sep. 5, 2023

(54) UNITARY RF CONNECTOR WITH GROUND CONTACT TABS ARRANGED IN CROWN, FOR A BOARD-TO-BOARD CONNECTION AND A GANGED CONNECTOR INCLUDING A PLURALITY OF SUCH UNITARY CONNECTOR, FOR A MULTIPLE BOARD-TO-BOARD CONNECTION

(71) Applicant: RADIALL SA, Aubervilliers (FR)

(72) Inventors: Gong Chen, Shanghai (CN); Shan Qin, Shanghai (CN); Laurent Petit, Saint Jean de Moirans (FR)

(73) Assignee: RADIALL, Aubervilliers (FR)

( * ) Notice: Subject to any disclaimer, the term of this patent is extended or adjusted under 35 U.S.C. 154(b) by 0 days.

(21) Appl. No.: 17/051,838

(22) PCT Filed: Oct. 2, 2019

(86) PCT No.: PCT/CN2019/109802
§ 371 (c)(1),
(2) Date: Oct. 30, 2020

(87) PCT Pub. No.: WO2021/062865
PCT Pub. Date: Apr. 8, 2021

(65) Prior Publication Data

US 2022/0302616 A1 Sep. 22, 2022

(51) Int. Cl.

| | |
|---|---|
| ***H01R 12/00*** | (2006.01) |
| ***H01R 12/70*** | (2011.01) |
| ***H01R 12/71*** | (2011.01) |
| ***H01R 12/73*** | (2011.01) |
| ***H01R 13/6587*** | (2011.01) |

(52) U.S. Cl.
CPC ..... *H01R 12/7082* (2013.01); *H01R 12/716* (2013.01); *H01R 12/732* (2013.01); *H01R 13/6587* (2013.01)

(58) Field of Classification Search
CPC ..... H01R 13/6582; H01R 13/6583; H01R 13/65; H01R 13/87; H01R 12/7082; H01R 12/716; H01R 12/732
USPC ..... 439/66, 660
See application file for complete search history.

(56) References Cited

U.S. PATENT DOCUMENTS

| | | | | |
|---|---|---|---|---|
| 6,231,352 | B1 | 5/2001 | Gonzales | |
| 2022/0302616 | A1 * | 9/2022 | Chen | H01R 12/732 |

FOREIGN PATENT DOCUMENTS

| | | | |
|---|---|---|---|
| CN | 108346876 | A | 7/2018 |
| WO | 2010/010524 | A1 | 1/2010 |
| WO | 2017/054106 | A1 | 4/2017 |

OTHER PUBLICATIONS

Chinese Office Action dated Jun. 8, 2022 for corresponding Chinese Application No. 201980016373.9 and English translation.

* cited by examiner

*Primary Examiner* — Khiem M Nguyen
(74) *Attorney, Agent, or Firm* — Pearne & Gordon LLP

(57) ABSTRACT

The present application relates to a unitary RF connector (1), intended for example to link two printed circuit boards (PCB1, PCB2), the unitary RF connector extending along a longitudinal axis (X), the connector being a unique piece with an electrically insulating block which serves as a rigid support for both flexible conductive elements whose central portions are rigidly respectively held therein for the central contact and on the outer wall of the block for the ground contact, and with an arrangement as crown for the plurality of free ends of the ground contact.

19 Claims, 10 Drawing Sheets

1
X
40
D
31
3
41
2
44
21
46
43
49
30
42
4
48
47

1
41
4
31
42
40
46
44
47
45
48
22
32
49

Fig.4A
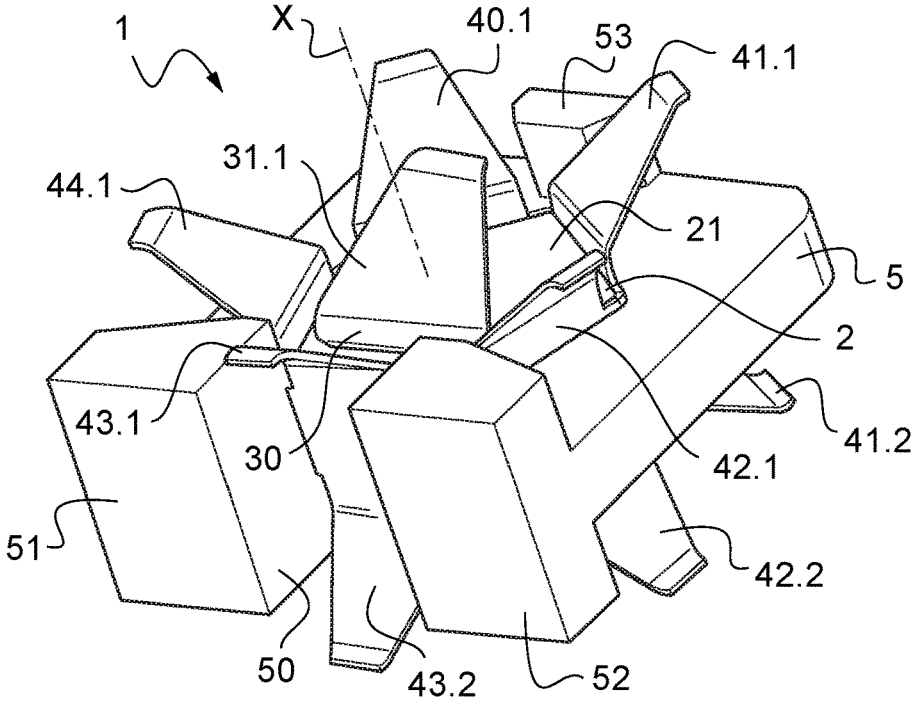
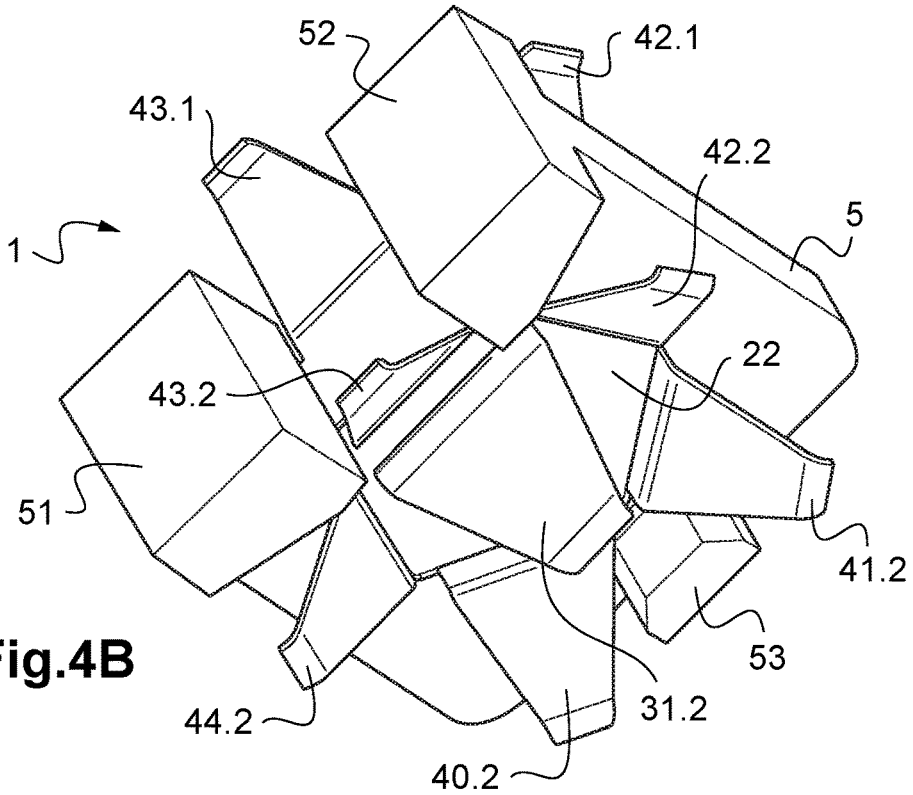
Fig.4B

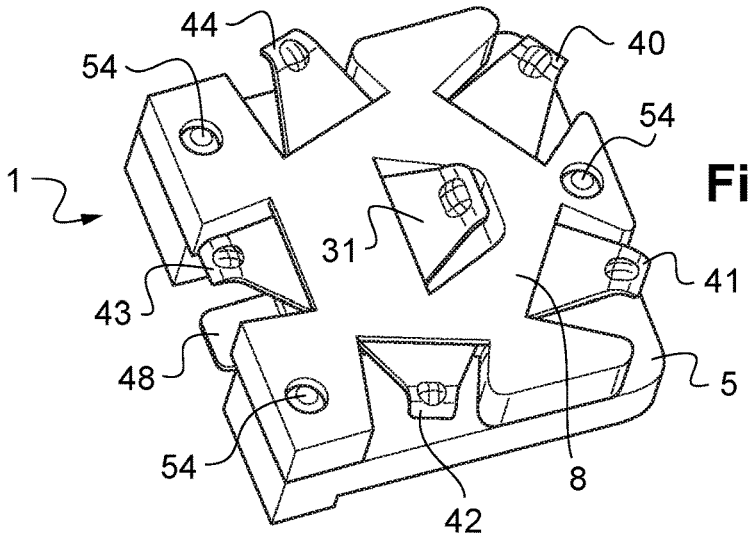
Fig.9
Fig.10
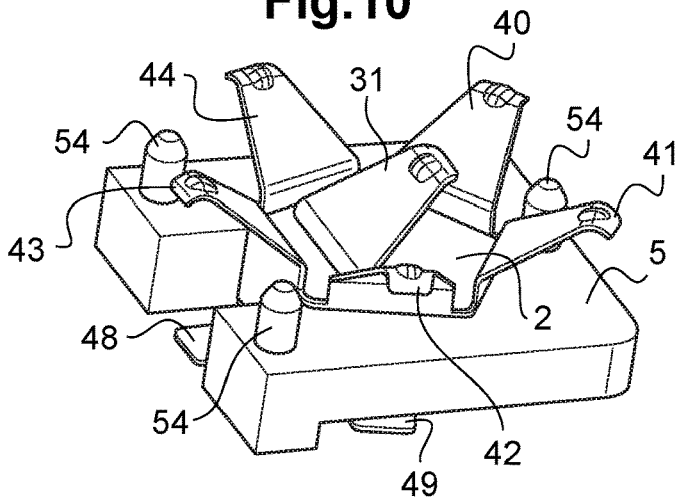
Fig.11
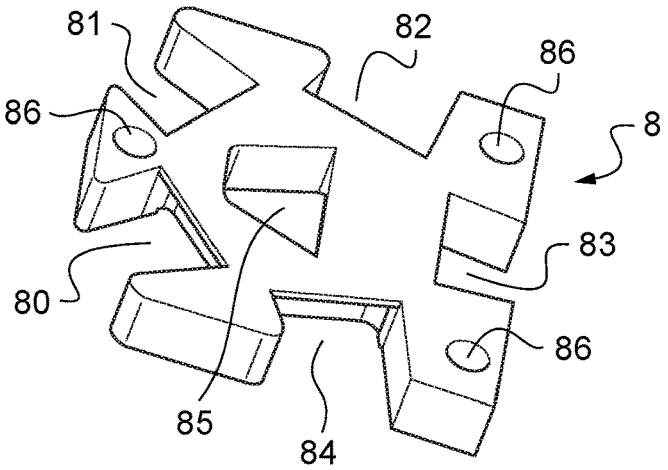

UNITARY RF CONNECTOR WITH GROUND CONTACT TABS ARRANGED IN CROWN, FOR A BOARD-TO-BOARD CONNECTION AND A GANGED CONNECTOR INCLUDING A PLURALITY OF SUCH UNITARY CONNECTOR, FOR A MULTIPLE BOARD-TO-BOARD CONNECTION

FIELD OF THE INVENTION

The present invention relates to a unitary RF connector.

Such a unitary connector can be used in particular to link two parallel printed circuit boards, usually called a board-to-board (B2B) connection or even a printed circuit board (PCB) to another component such as a module or a filter.

The invention applies, for example, to a connection used to link boards inside RRU/RRH (remote radio unit/remote radio head) transmitter modules for the wireless communications market.

The invention also relates generally to the connection in the medical domain, the aeronautical or transport domain, the space domain or even the telecommunications domain.

By "RF connector", it is to be understood a connector able to transmit signals from the Direct Current (DC) range to the radiofrequency (RF) range, including the hyperfrequency (HF) range, the signals being high speed digital signals (HSDL for High Speed Data Link) or radiofrequency (RF) signals.

BACKGROUND OF THE INVENTION

With the continuous development of wireless communication technology, board to board connectors are becoming more and more widely used in wireless system module interconnection, such as communication base station, RRH, repeater, GPS devices, and other similar applications. Three major trends of wireless devices are smaller dimensions, lower cost, and easier installation. For a board to board connection, the market also requires them to be smaller, cheaper and more modularized.

There are already on the market and in the prior art examples of connection assemblies dedicated to the telecommunications sector for cellular radiotelephony infrastructures. In fact, the trend in this market is to minimize the losses of the RF (radiofrequency) part in order to reduce the amplifying elements of the base stations. For this, on the one hand, the actual radio part of the stations is being increasingly relocated as close as possible to the transmission-reception antennas, in the RRU/RRH transmitter modules, and on the other hand, the RF leads internal to the radio unit are being replaced by direct interconnections.

So-called board-to-board connections have thus been developed according to the successive generations of the last decade.

A first generation of connection assemblies is thus known, for directly interconnecting boards, for example marketed under the names SMP, SMP-Com, MMBX from Radiall with limited axial misalignment to a few tenths of a millimetre, of the order of 0.3 mm to 0.6 mm. SMP series are standardized in accordance with MIL STD 348 specifications, the DESC specifications 94007 & 94008A second generation of connection assemblies is also known, with bigger axial misalignment from 2 mm to 2.4 mm, for example marketed under the names SMP-MAX by the company Radiall or else marketed under the names MBX by the company Huber and Suhner or else marketed under the name AFI by the company Amphenol RF, or else marketed under the name Long Wipe SMP and P-SMP by the company Rosenberger.

Although there are different degrees of axial misalignment between two generations, the working principle for radial misalignment and connection is the same for two generations. Such connection assemblies respectively consist of a first socket of snap-fitting (or "snap") type, a second socket of "sliding" (or smooth bore) type with a guiding cone ("slide on receptacle"), and a connection coupling called adaptor, with the first and second sockets respectively fastened to the ends thereof. The connection is therefore made blind by the re-centring of the connection coupling by means of the guiding cone of the sliding socket. The radial misalignment is obtained by a rotation of the coupling in the groove of the snap-fitting socket. The first and second sockets are conventionally made of brass and have no elastic functions. The connection coupling is typically made of an expensive noble elastic metallic material, for example CuBe2 or CuSn4Pb4Zn4, and provided at each of its ends with elastic means (petals and slots for example) that cooperate with the first and second sockets.

All the known board-to-board connections do however present a significant number of drawbacks.

On the one hand, because the couplings of these connections have elastic means generally consisting of petals at their ends, they can be fragile. The adapter can be rotated in the groove of the snap-fitting socket, there is tilting angle during installation, can be bigger than 4°. Thus, it is commonplace, when connecting blind, for the coupling to be damaged when it comes into contact with the guiding cone of a sliding socket. In particular for a large distance between boards to be connected, considering the cost of sliding socket and the room of equipment, the guiding cone can't change bigger enough for blind, the manual assistance for the connection is necessary. This unsafe installation solution can't meet the requirement of the multiple connections in the new generation cellular radiotelephony infrastructures.

On the other hand, the configuration of the connections does not make it possible to obtain a sufficiently great radial and/or axial misalignment. Significant rotation angles, typically greater than 3.5°, cannot be reached without causing an undesirable permanent deformation of the elastic means of the coupling. This permanent deformation causes a significant degradation of the electrical performance levels (electrical continuity), which de facto limits the radial misalignment allowed, in particular for a small distance between boards to be connected.

At last, the cost of producing these connections is relatively high, thus constituting a brake for this type of market. Producing the connection coupling from a noble material, in particular when the coupling has a significant length, and producing possible slots in this coupling results in not-inconsiderable production costs.

In the case of the connection assembly according to the patent application WO 2010/010524, said connection needs in fact three different pieces which are connector elements, namely two receptacles which are each soldered on a PCB and one elongated rigid coupling to connect together the two receptacles. When applied in massive board to board connection, it might result of this type of solution a very big insertion force and make the connection between two PCB difficult.

Another current solution to realize a board to board connection is described in U.S. Pat. No. 6,231,352B1 patent. The disclosed coaxial coupling allows to adopt only one connector to realize the board to board connection.

In WO2017/054106 patent application, the applicants have also proposed a unitary RF connector with an electrically insulating block which serves as a rigid support for flexible conductive elements whose central portions are rigidly respectively held therein and/or on the outer wall of the block. This solution is good for applications which require some modularization and standardization.

Even if the connectors according to U.S. Pat. No. 6,231,352B1 and to WO2017/054106 present good RF performances, there is a need to further improve these latter, notably the insulating characteristics when the board to board connections require a plurality of unitary connectors arranged close to each other, notably in a common holder.

In more general terms, there is a need to further improve the board to board connections, in particular by providing the minimum of pieces required for the connection, by allowing an installation with less solder in order to improve the installation efficiency, an easy maintenance with the possibility to easily extract the connection, a certain misalignment tolerance, a controlled impedance line with good RF performances, the possibility of an easy standardization and modularization and, at low cost.

The invention aims to address all or part of these needs.

SUMMARY OF THE INVENTION

Thus, the subject of the invention, according to one of its aspects, is a unitary RF connector, intended in particular to link two printed circuit boards, said unitary RF connector extending along a longitudinal axis (X) and comprising:

- a first electrical insulating body which is rigid;
- a conductive strip forming a central contact retained within the first insulating body; which comprises at, at least one of its free ends, a first tab being configured as a spring able to flex toward one of the end face of the insulating body taking any closer position when acted upon by a pressure force of a complementary connection element, such as a printed circuit board (PCB);
- a ground contact comprising a conductive body which is closed on itself and retained around the insulating body and, at, at least one of the free end of said conductive body, at least three second conductive tabs, extending oblique relative to and towards the outside of the conductive body, each second conductive tab being configured as a spring able to flex toward the conductive body taking any closer position when acted upon by the pressure force of the complementary connection element, the at least three second conductive tabs being arranged in crown, around the conductive body.

By "extending oblique relative to and towards the outside", it should be understood that the tabs of at least one end of the ground contact is extending oblique and outside the conductive body, either by being completely plane or comprising curved or inflexion portions or by being folded on itself.

In other words, the invention consists in defining a one-piece connector with an electrically insulating block which serves as a rigid support for both flexible conductive elements whose central portions are rigidly respectively held therein for the central contact and on the outer wall of the block for the ground contact, and with an arrangement as crown for the plurality of free ends of the ground contact.

Compared to the known connectors for board-to-board connections, the arrangement in crown according to the invention allows to reduce space between two adjacent free ends of ground contact at the level of the PCB and thus to have minimal RF signal leaks and hence a better isolation of the transmission path of said connector.

Along with the higher number of grounding paths compared to the prior art, the grounding angular coverage is greatly improved with the tabs enhancing both shielding effectiveness and crosstalk between board to board connector. In particular, this crosstalk prevention is important for most applications, more specifically for Telecom Massive MIMO. In the range DC-6 GHz, the distance between two adjacent extremities of ground contacts is less than 3 mm, typically 2.8 mm, to be compared with the 3.6 mm distance in a connector according to U.S. Pat. No. 6,231,352B1 patent. This also improves performances above 6 GHz but to a lesser degree as frequency rises.

In other words, the arrangement in crown allows to better confine the electromagnetic field into the connector.

The increasing of the RF signal isolation can be typically from 10 to 20 dB.

In the preferred embodiment, the connector comprises a second electrical insulating body surrounding at least partially the conductive body while being retained around this latter.

According to this embodiment, in preferred variant, the second insulating body is closed around the conductive body, except of a slot arranged at the location of a second conductive tab, preferably said slot opening outwards and on the conductive body on the entire height of the second insulating body.

Advantageously, the second insulating body comprises at least one pillar and which height being determined to protect the second tabs against the over flexion. Thus, whatever the compression force which is applied to achieve the board-to-board connection, the seconds tabs cannot be damaged and stay always elastically deformable with a sufficient contact force with the corresponding track of the PCB.

Preferably, at least one pillar is located near a second conductive tab.

According to an embodiment, the connector comprises a protection insulating part which is arranged and maintained on the top of the second insulating body, said protection insulating part comprising peripheral cutouts or through holes over the entire height of the part and a central through hole which let through respectively the flexible ground tabs and the flexible central tab.

A preferred variant is that the connector comprises individual supports which are protruding from the top face of the second insulating body and beneath each flexible ground and central tabs.

According to another variant, the second insulating body comprises pins which are protruding from its top and which serve to guide the protection part above the insulating body.

Preferably, the height of the protection part or of the pillars is such that it protects each flexible ground and central tabs.

According to another preferred embodiment, the cross-section, transversely to axis (X), of the first electrical insulating body and of the conductive body of the ground contact is a regular pentagon, said ground contact comprising five second conductive tabs arranged in crown, each of the second conductive tab extending from a side of the pentagonal conductive body. This pentagonal structure is particularly advantageous in terms of RF performances and costs.

According to a first configuration, both free ends of each of the ground and the central contacts are each configured as a spring forming the first and second conductive tabs intended to come into electrical contact by the pressure force with a conductive track of one of the first and second printed circuit board (PCB1, PCB2).

Otherwise said, this first configuration allows a board-to-board connection, solderless type with a direct contact with a PCB per side.

According to a second configuration, only one free end of each of the ground and the central contacts is configured as a spring forming the first and second conductive tabs intended to come into electrical contact by the pressure force with a conductive track of the first printed circuit board (PCB1), while the other one free end of each of the ground and the central contacts is rigid forming the first and second conductive tabs intended to be soldered to a conductive track of the second printed circuit board (PCB2). This second configuration allows a board-to-board connection with a solder with one PCB on a side and a direct contact solderless with the other PCB on the other side.

An advantageous embodiment consists of a stack of two connectors according to this second configuration, where each connector is soldered on each PCB and both connectors are in mutual contact by their flexible tabs. In this embodiment, all parts are soldered on at least one side in accordance with some customer requirements. No holder is then required. There are two advantages for this embodiment. Firstly, it allows a larger axial misalignment than on FIG. 2 due to two sides elastic petal contact. Secondly, if the height of a standard connector is H and if the B2B distance of a customer is 2H, no extra product development nor tooling has to be launched, as the standard connector according to the invention is just used twice.

Preferably:

- the central contact is formed by a metal strip that is curved at each of its ends, said curved ends constituting the first conductive tabs;
- the ground contact is made as a single piece by being cut out from a metal sheet and being rolled up;
- the first insulating body is overmolded on the central contact and the ground contact is assembled with the insulation body;
- the second insulating body is overmolded or assembled around the ground contact.

The main advantages obtained by the RF unitary connector according to the invention are numerous and can be itemized as follows:

- the possible transmission of high-speed digital signals (HSDL for High Speed Data Link) or of radiofrequency (RF) signals up to 15 GHz thanks to the controlled impedance line of the unitary connector,
- the presence of pillars or a protection part ensures that the minimum distance between PCB is respected and so protect the contacts of the connector;
- the protection of the ground contact body by the second electrical insulating body, which prevents said ground body to open.
- when the distance between the two PCB to be connected changes, only the modification of the length of the connector is needed to meet the requirements, which is good for a standardization;
- the possible use of the unitary connector in a configuration with a holder in which it is arranged according to a floating mounting, and hence solderless, or soldered at one of its ends onto a PCB;
- the possible use of a plurality of unitary connectors in a ganged configuration each with a holder in which they are arranged according to a floating mounting for a multiple parallel interconnection, which is good for a modularization;
- the possible stack of two connectors according to the invention with the flexible second tabs in mutual contact;
- the facility of achieving different heights of board to board connections, by stacking different heights of the unitary connector;
- a good control of the electrical contact resistance and the misalignment tolerance thanks to the deflection of the free ends of the second conductive tabs;
- the insertion and withdrawal forces are drastically reduced in comparison to a usual interconnect assembly with pin-socket conventional contacts;
- the unitary connector can be easily extracted from the holder, which makes it quite convenient for the maintenance;
- the costs for realizing the unitary connector are very reduced compared to the connection solutions according to the prior art;
- a very good confinement of the electromagnetic field into the connector, i.e. no resonance between the two PCB connected by the connector;
- a higher operating frequency compared to the connectors according to the prior art;
- a very good signal isolation between two adjacent connectors according to the invention, typically more than 60 dB for an axis-to-axis distance of 10 mm.

According to another aspect, the invention concerns a connection module, intended to be used to link two printed circuit boards comprising at least one unitary RF connector such as described above except for the variant with the rigid tab(s) to be soldered.

According to an advantageous embodiment, the connection module comprises at least a stack of two identical unitary RF connectors wherein each of the flexible tabs of the central contact and of the flexible tabs of the ground contact of one connector is in flexible contact with a corresponding flexible tab of the other connector.

According to another embodiment, the connection module comprises at least one holder comprising a frame closed on itself with at least one opening in which each unitary connector is accommodated according to a floating mounting;

Advantageously, the second insulating body is directly floating mounted into the holder.

According to another aspect, the invention concerns the use of the unitary RF connector described above or a connection module described above, to transmit RF (radiofrequency) signals or HSDL (High Speed Data Link) signals.

BRIEF DESCRIPTION OF THE DRAWINGS

Other advantages and features of the invention will become more apparent upon reading the detailed description of exemplary implementations of the invention, given by way of non limiting illustration, and with reference to the following figures, in which:

FIG. 4A is a perspective view of a unitary connector according to a second embodiment of the invention, with the outside surrounding insulating body;

FIG. 4B is another perspective view of the unitary connector of FIG. 4A;

FIG. 9 is a perspective view of a unitary connector according to a third embodiment of the invention, with an outside surrounding insulating body and with a protection part which is arranged and maintained on the top of said outside insulating body;

FIG. 10 is a perspective view of the part of the unitary connector according to FIG. 9, without the protection part which has been removed;

FIG. 11 is a perspective view of the protection part of the unitary connector according to FIG. 9;

FIGS. 1A and 1B and show a first embodiment of a unitary radiofrequency (RF) connector 1 extending along a longitudinal axis X and comprising firstly a first electrical insulating body 2 which is rigid. This unitary connector 1 is intended to make a board-to-board connection between two printed circuit boards (PCB1, PCB2).

Figure 1A:
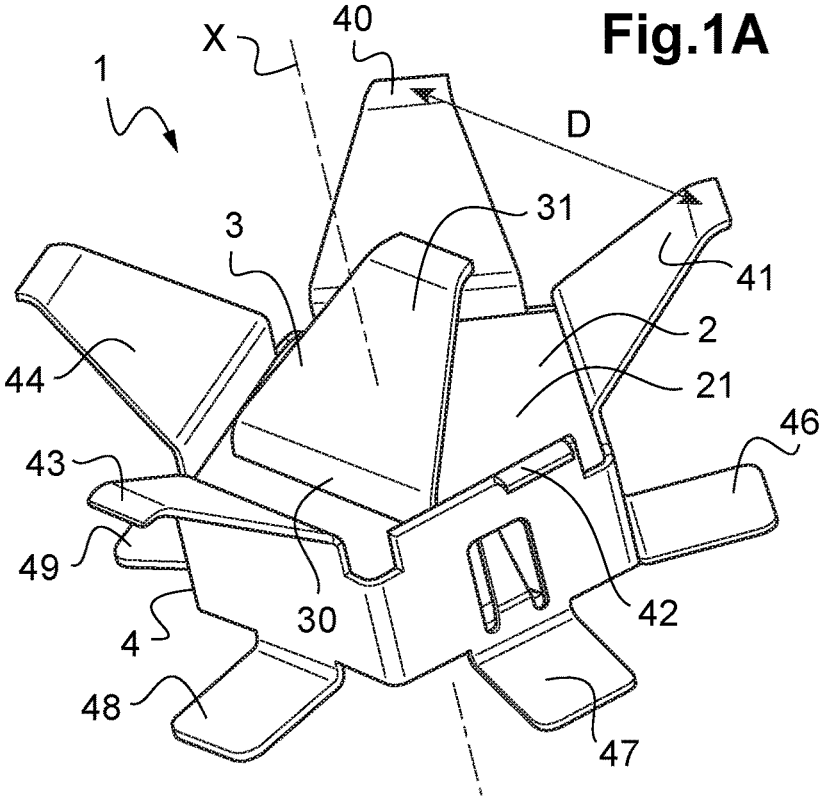
FIG. 1A is a perspective view of a unitary connector according to a first embodiment of the invention, without the outside surrounding insulating body
Figure 1B:
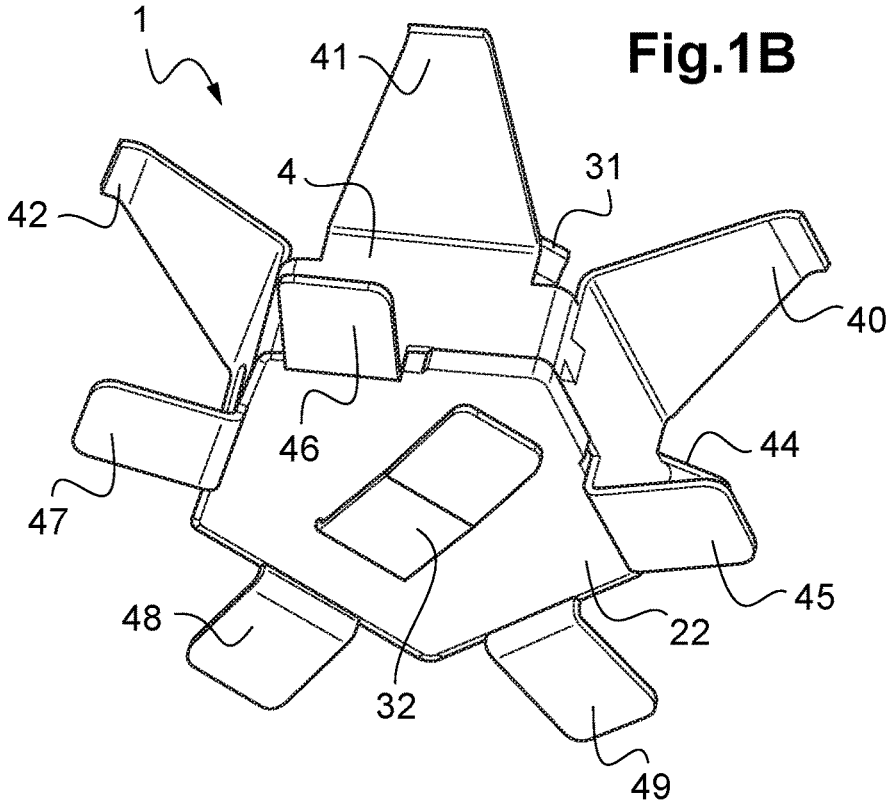
FIG. 1B is another perspective view of the unitary connector of FIG. 1A.

A metal strip 3 forming a central contact comprises a central portion 30 which is retained inside the insulating body 2 and at the two free ends of the strip, two tabs 31, 32 which are arranged outside the insulating body. Both free ends 31, 32 of the central contact 3 are each incurved toward an end face 21, 22 of the insulating body 2. One free tab 31, is flexible such as it is configured as a spring. The other end tab 32 is rigid and curved at right angle.

Advantageously, the flexible tab 31 and the rigid tab 32 of the central contact strip 3 may comprise an embossment forming a contact point.

A conductive body 4 is closed on itself and retained around the first insulating body 2.

At one free end of said conductive body 4, five conductive tabs 40, 41, 42, 43, 44 are extending oblique relative to and towards the outside of the conductive body 4.

Each of the five conductive tabs 40, 41, 42, 43, 44 is configured as a spring able to flex toward the conductive body taking any closer position when acted upon by the pressure force of one of the PCB1, PCB2.

According to the invention, the five conductive tabs 40, 41, 42, 43, 44 are arranged in crown, around the conductive body 4.

In an advantageous way, each flexible five conductive tab 40, 41, 42, 43, 44 of the ground contact comprises an embossment forming a contact point. This contact point defines a precise electrical contact with a contact of a complementary connection element, such as a conductive track of a PCB. It also avoids any scratch with the PCB.

At the other free end of said conductive body 4, five other conductive tabs 45, 46, 47, 48, 49 are extending oblique relative to and towards the outside of the conductive body 4.

Each of the other end tab 45, 46, 47, 48, 49 is rigid and curved at right angle.

According to the invention, the five conductive tabs 40, 41, 42, 43, 44 on one end and the other five conductive tabs 45, 46, 47, 48, 49 are arranged in crown, around the conductive body 4.

The conductive body 4 and all the conductive peripheral tabs 40 to 44 and 45 to 49 forms the ground contact of the connector 1.

Due to the arrangements in crown, the space distance between two adjacent tabs is reduced compared to the connectors according to the prior art. Typically, for a working frequency of around 15 GHz, the distance D, shown on FIG. 1A, between the two ends of adjacent tabs, is 2.8 mm, compared to the 3.6 mm distance in a connector according to U.S. Pat. No. 6,231,352B1 patent.

Therefore, the RF signal leaks are notably reduced and hence the RF signal transmission path in the connector 1 is better insulated.

Preferably, the ground contact is made as a single piece by being cut out from a metal sheet and being rolled up.

Figure 2A:
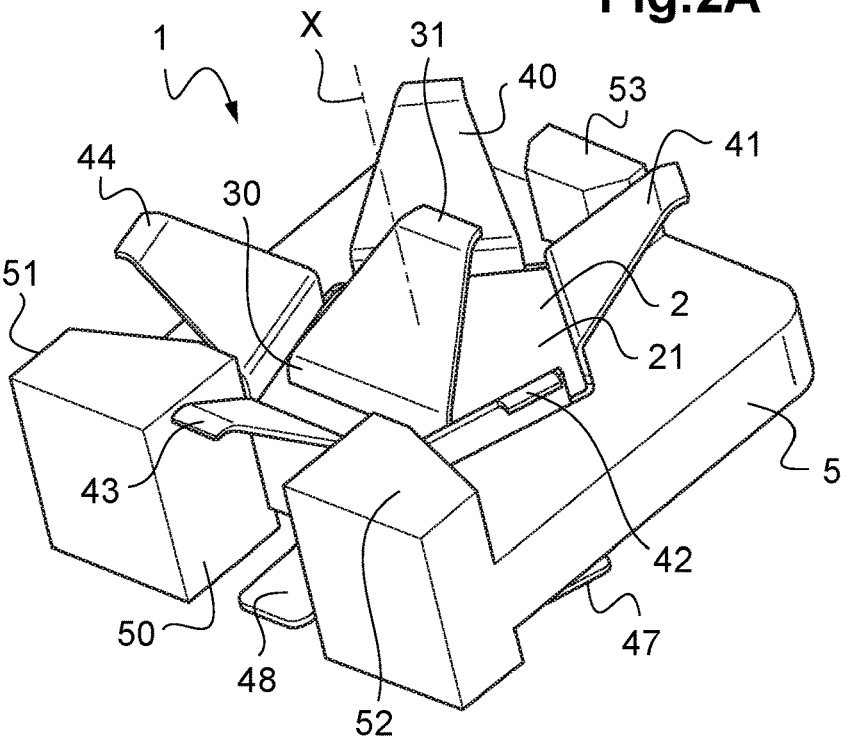
FIG. 2A is a perspective view of a unitary connector according to a first embodiment of the invention, with the outside surrounding insulating body
Figure 2B:
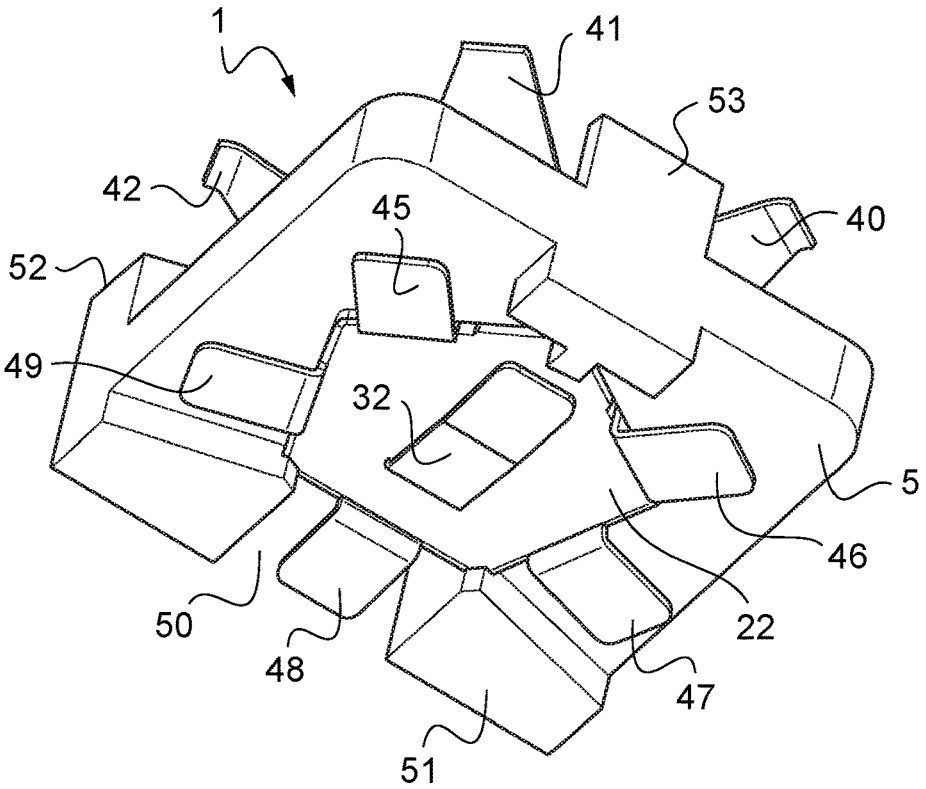
FIG. 2B is another perspective view of the unitary connector of FIG. 2A.
Figure 3A:
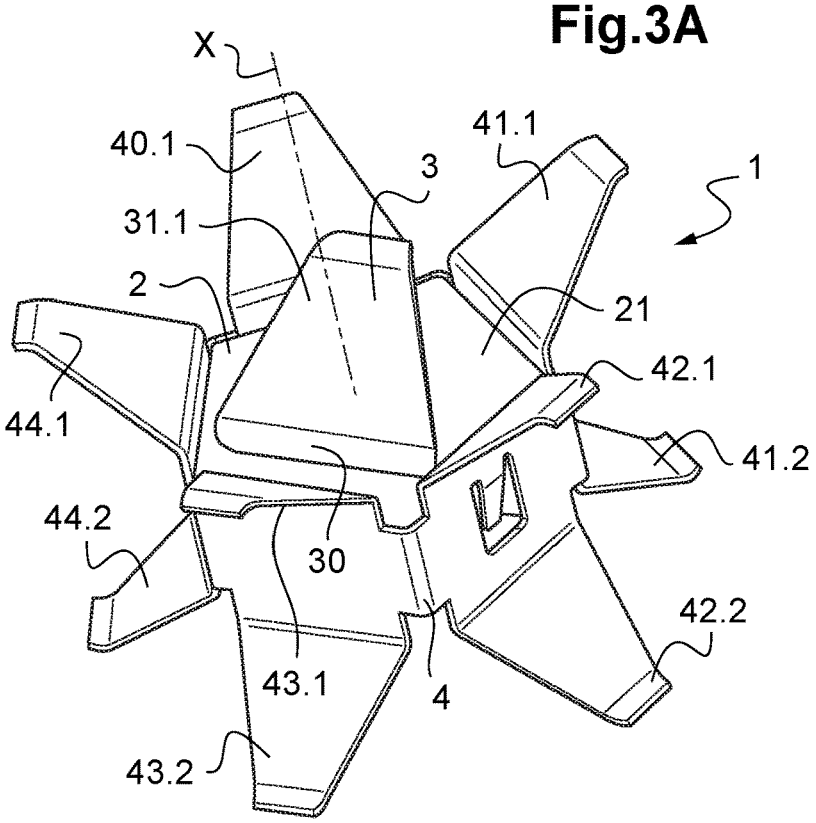
FIG. 3A is a perspective view of a unitary connector according to a second embodiment of the invention, without the outside surrounding insulating body
Figure 3B:
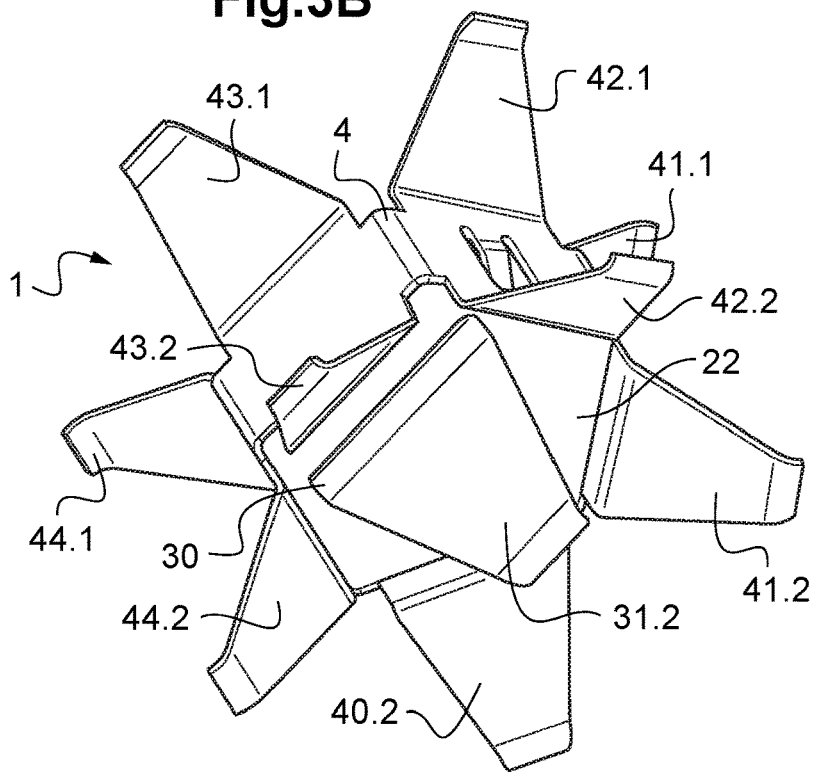
FIG. 3B is another perspective view of the unitary connector of FIG. 3A.

According to an advantageous variant shown on FIGS. 2A and 2B, it is provided a second insulating body 5 which surrounds the conductive body 4, except of a slot 50 arranged at the location of one of the conductive flexible tab 43 and rigid tab 48.

This slot 50 is related to the process of overmolding. As it is shown, the slot 50 opens outwards and on the conductive body 4 on the entire height of the second insulating body 5.

Preferably, the second insulating body 5 comprises at least one pillar, two pillars 51, 52 on both sides of the slot 50 as shown and one pillar 53 on the other side. The height of said pillars is determined to protect the tabs 40, 41, 42, 43, 44, against the over flexion during the connection.

Preferably also, the first insulating body 2 is overmolded on the portion 30 of the central contact 3, the ground contact 4 is assembled with the insulation body 2 and the second insulating body 5 is overmolded around the ground contact 4.

A RF connector 1 according to the first embodiment shown on FIGS. 1A, 1B, 2A and 2B makes the interconnection between the two PCB1, PCB2 by soldering only one end of the connector.

It means that the flexible tab 31 of the central contact 3 and flexible tabs 40 to 44 of the ground contact are intended to come into electrical contact by the pressure force with a conductive track of one printed circuit board (PCB1), while the rigid tab 32 of the central contact 3 and rigid tabs 45 to 49 are intended to be soldered to a conductive track of the second printed circuit board (PCB2).

Figure 5:
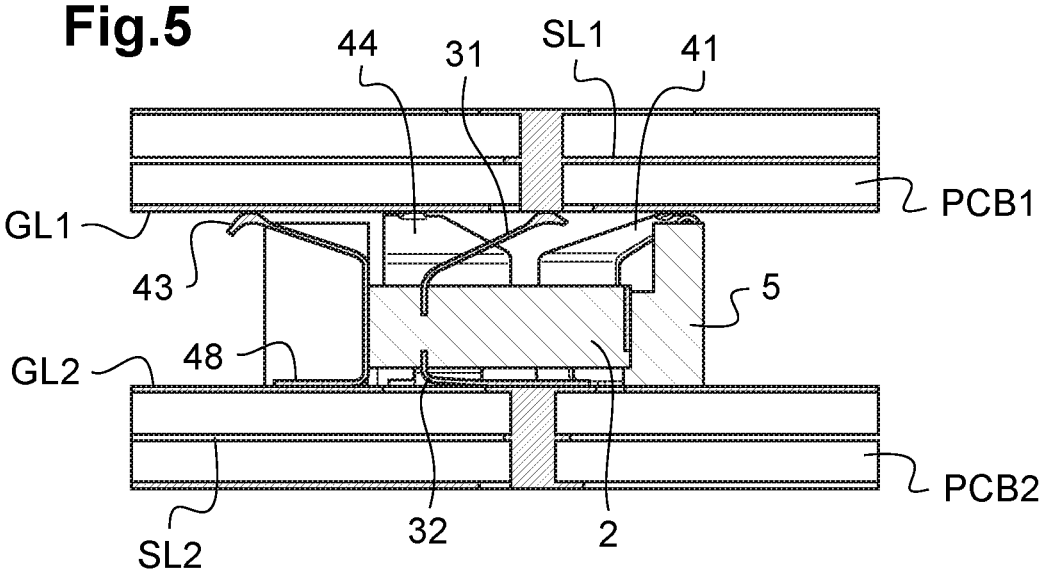
FIG. 5 is a cross-sectional view of a unitary connector according to the first embodiment of the invention, with the outside surrounding insulating body.

This configuration is shown on FIG. 5, where it can be seen that the signal lines SL1 and SL2 of respectively PCB1, PCB2 are electrically connected by the rigid tab 32 soldered to the conductive track SL2 while the flexible tab 31 is deflected by exerting a contact force onto the conductive track SL1. The ground lines GL1 and GL2 of respectively PCB1, PCB2 are electrically connected by the rigid tabs 45 to 49 soldered to the conductive track GL2 while the flexible tabs 40 to 44 deflected by exerting a contact force onto the conductive track GL1.

The second embodiment of the connector 1 shown on FIGS. 3A, 3B and 4A, 4B differs from the first embodiment in that the rigid tabs at one end of the connector 1 are replaced by flexible tabs which are similar or identical to the flexible tab 31 of the central contact and the flexible tabs 40 to 44 of the other end of the connector 1.

In other words, in this second embodiment, both free ends 31.1, 31.2 of the central contact 3 are flexible and each incurved toward an end face 21, 22 of the insulating body 2. And at both free ends of the conductive body 4, ten conductive tabs 40.1, 41.1, 42.1, 43.1, 44.1; 40.2, 41.2, 43.2, 44.2 are flexible and extending oblique relative to and towards the outside of the conductive body 4.

It can be noted that the surrounding insulating body 5 is similar for the first and the second embodiments.

Figure 6:
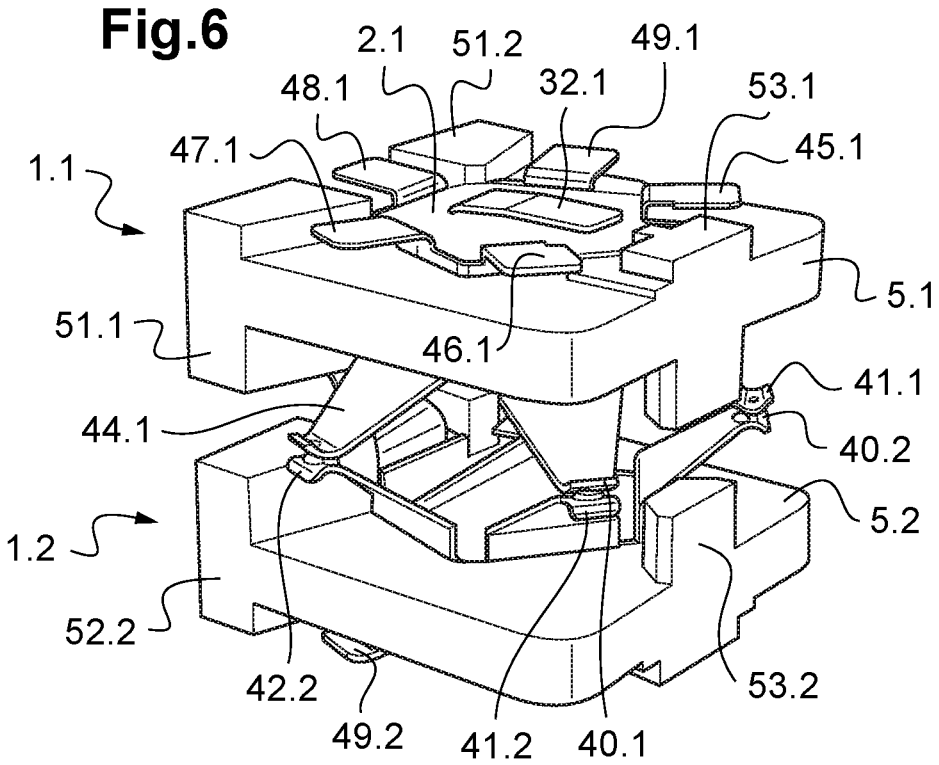
FIG. 6 is a perspective view similar of two unitary connectors according to the first embodiment of the invention, which are stacked on top of each other with their flexible conductive tabs in mutual contact.

An advantageous configuration which allows the invention, is shown on FIG. 6. It can be seen a stack of two identical unitary connectors 1.1, 1.2 according to the first embodiment. Each of the flexible tabs 31.1 of the central contact 3 and of the flexible tabs 40.1 to 44.1 of the ground contact of one connector 1.1 is in flexible contact with a corresponding flexible tab 31.2 or 40.2 to 44.2 of the other connector 1.2.

In this configuration also, the rigid tabs 32.1, 32.2 of the central contacts and the rigid tabs 45.1 to 49.1 and 45.2 to 49.2 of the two connectors 1.1, 1.2 are each intended to be soldered to a track of a PCB.

In the embodiments of the connector 1 shown on FIGS. 1 to 13, the cross-section, transversely to axis (X), of the first electrical insulating body 2 and of the conductive body 4 of the ground contact is a regular pentagon, with the five flexible conductive tabs 40, 41, 42, 43, 44 or 40.1 to 44.1, 40.2 to 44.2 and the five rigid tabs 45 to 49 arranged in crown, each of the tabs extending from a side of the pentagonal conductive body.

Figure 7:
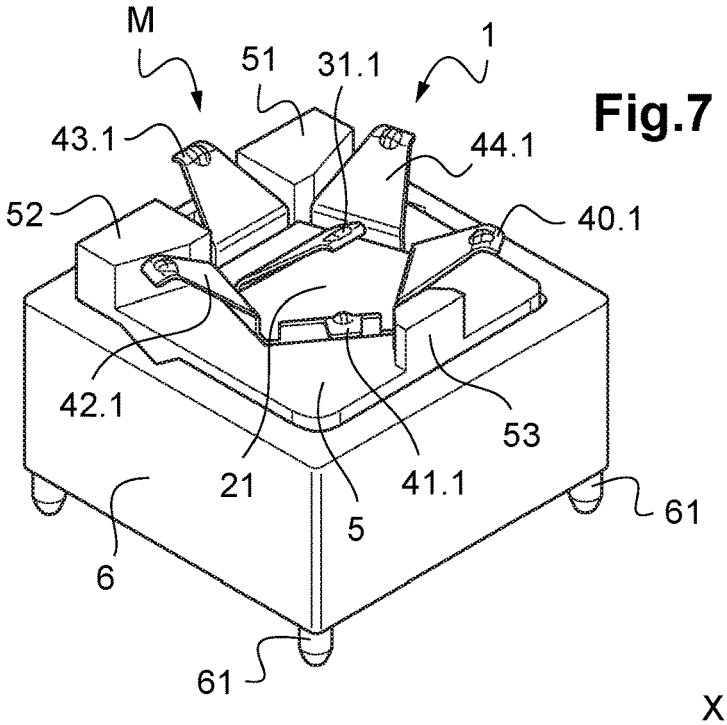
FIG. 7 is a perspective view of a connection module comprising a holder in which a unitary connector according to the invention is floating mounted intended to be used with a plurality of similar connection modules for a multiple parallel board-to-board interconnection.
Figure 7A:
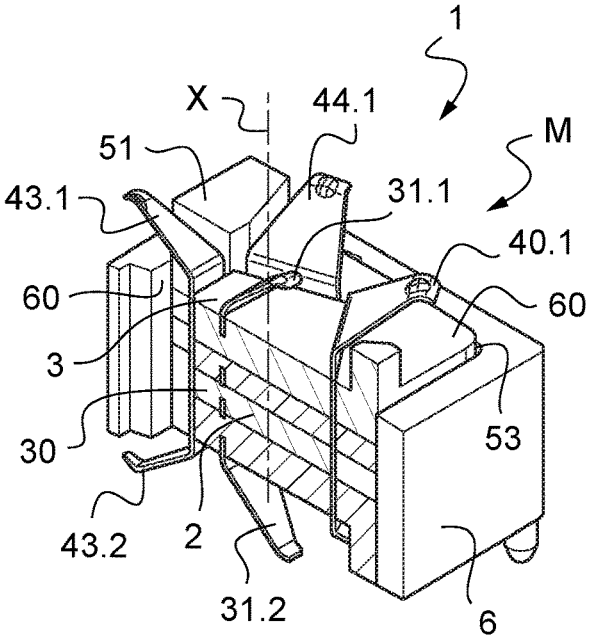
FIG. 7A is a cross-sectional perspective view of the connection module of FIG. 7.

According to an advantageous variant shown on FIG. 7, it is provided a holder 6 which comprises a frame closed on itself with an opening 60 in which one unitary connector 1 is accommodated according to a floating mounting.

By "floating mounting", it is to be understood the usual technological meaning, i.e. a mounting allowing a certain displacement in translation of the unitary connector into the frame.

The functions of this holder 6 are as follows:

- retention of one connector 1 according to the invention;
- guiding the connector 1 before the connection with the complementary connection elements is ensured.

The holder 6 is preferably in plastics material.

The solution of the variant according to FIG. 7 has the two following advantages:

- the connector doesn't need to be soldered on the PCB, the PCB directly contacts the connector through the elastic petals by pressing;
- the axial misalignment of the connector is twice the alignment of the connector of FIGS. 1A, 1B and FIGS. 2A, 2B.

Figure 8:
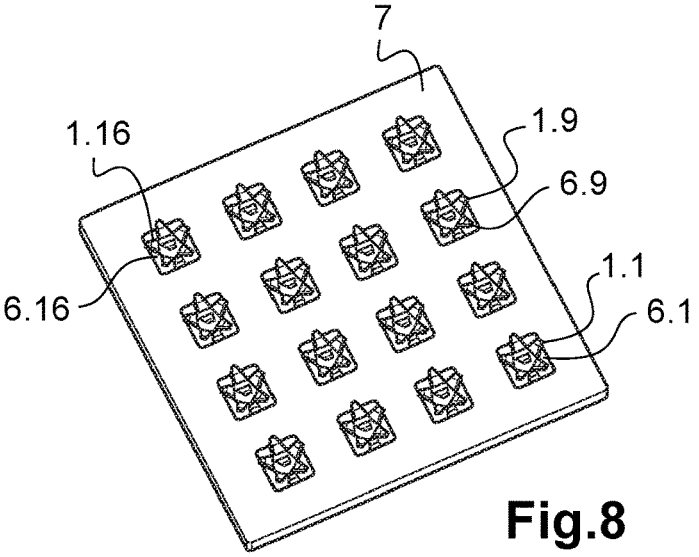
FIG. 8 shows a matrix in which a plurality of holders with their connectors according to the invention are inserted.

FIG. 8 shows multiple parallel connections (16 channels in the illustrated example), with a common guiding spacer 7 in which the plurality of holders 6.1 to 6.16 with their connectors 1.1 to 1.16 are inserted.

FIGS. 9 to 11 show another embodiment of the surrounding insulating body 5. In this embodiment a protection insulating part 8 is arranged on the top of the insulating body 2.

More precisely, the insulating part 8 is mated with interference by indexing and connecting pins 54 protruding on the top face of the insulating body and which are mated into corresponding holes 86 drilled in the protection part 8.

Besides, the protection part 8 includes peripheral cutouts 80 to 84 over the entire height of the part and a central through hole 85 which let through the flexible ground tabs 41 to 44 and the flexible central tab 31. This embodiment allows to mechanically protect the flexible tabs 41 to 44 and 31 in case of an unexpected mechanical effort which would be applied transversally to axis X, either during the B-to-B connection or during any kind of manipulations.

The manufacturing of the protection part 8 and the assembly with the insulating body 5 can be achievable with a current process.

Figure 12:
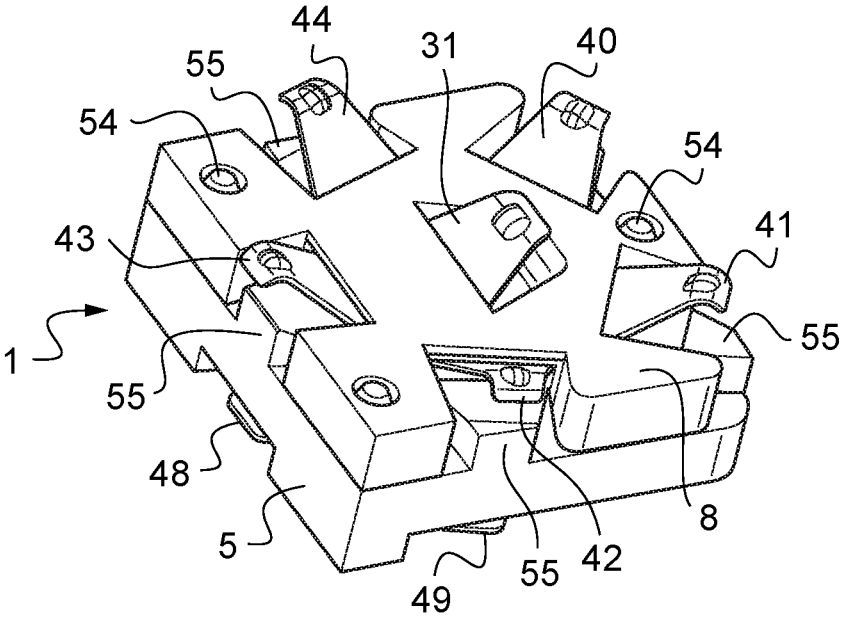
FIG. 12 is a perspective view of a variant of the connector according to FIG. 9, with a different design of the outside surrounding insulating body but with the same protection part on the top of the insulating body.
Figure 13:
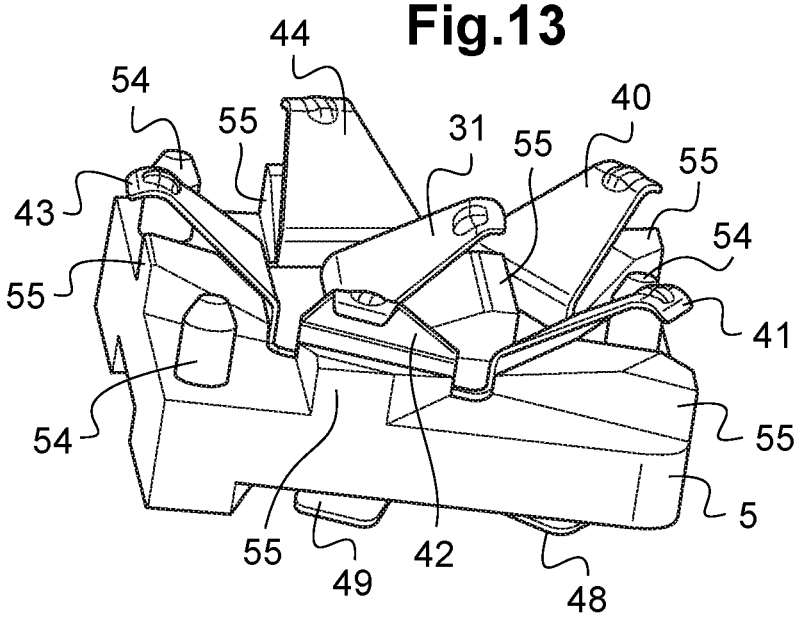
FIG. 13 is a perspective view of the part of the unitary connector according to FIG. 12, without the protection part which has been removed.

An advantageous variant of the previous embodiment is shown FIGS. 12 and 13 with the same protection 8.

Here, the protection structure is made of individual local supports 55 which are protruding from the top face of the insulating body 5, beneath each flexible ground and central tabs 31, 41 to 44, and which function is to protect these latter against the over flexion during the connection. The pillars 51, 52 and 53 are replaced by pins 54 which are protruding from the top face of the insulating body 5.

In other words, the connector 1 shown on FIG. 12 is combining the protection of over flexion like the connector of embodiment 2A and 2B and the protection against unexpected transversal mechanical forces like the connector 1 of embodiment of FIG. 9.

Moreover, the pins 54 guides the protection part 8 above the insulating body 5. Due to its height, the protection part 8 can also be considered as a pillar in order to protect each flexible ground and central tabs. The height of the pins 54 may also be higher than the height of the protection part and they can be considered as pillars as well in this case.

There are two advantages for such a stack configuration. Firstly, there are larger axial misalignment than the FIG. 2 due to two sides elastic petal contact. Secondly, if the height of the connector is H, and the final user wants the height twice for a B2B connection, that is 2×H, no extra product development nor tooling has to be launched, because of the direct use two connector with heights 31, 40 to 44.

The embodiment of FIGS. 9 and 12 are more protective of the petals 40 to 44 and 31 than the configuration described in FIGS. 2A and 2B.

Figure 14:
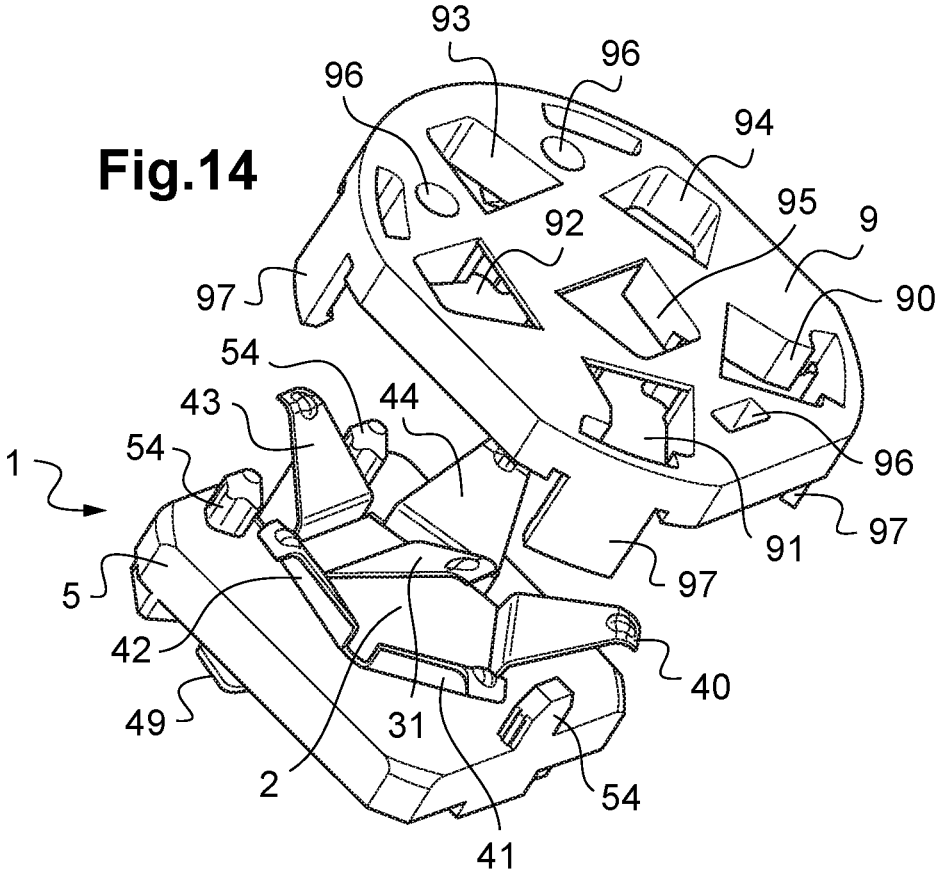
FIG. 14 is an exploded perspective view of a variant of the third embodiment of the unitary connector according to the invention, with an outside surrounding insulating body and with a protection part which is arranged and maintained on the top of said outside insulating body.
Figure 15:
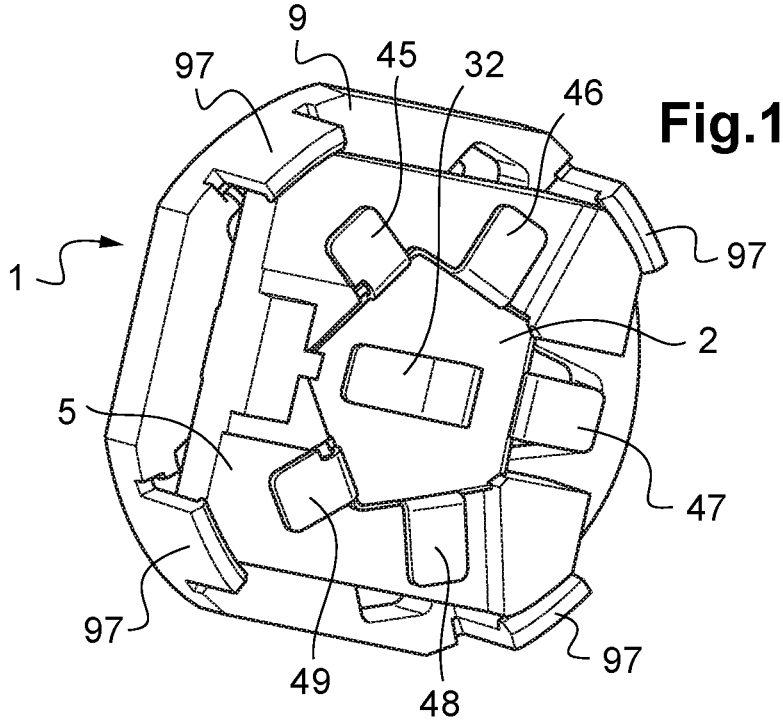
FIG. 15 is a perspective view of the part of the unitary connector according to FIG. 14, assembled together with the protection part.
Figure 16:
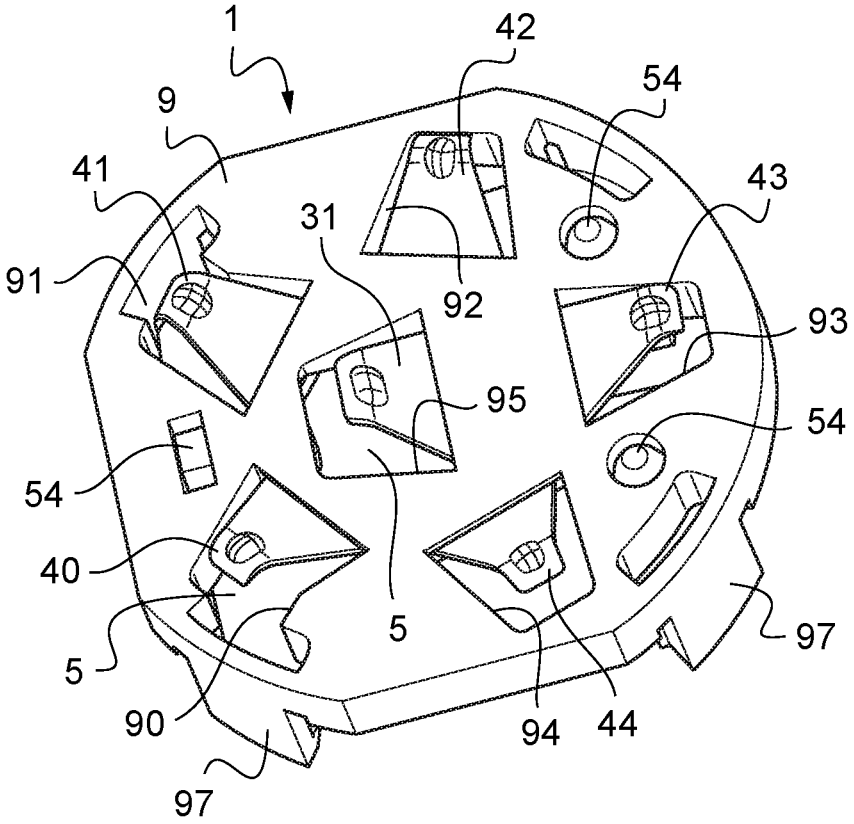
FIG. 16 is another perspective view of the part of the unitary connector according to FIG. 14, assembled together with the protection part.

FIGS. 14 and 15 show a variant of the embodiment with a protection insulating part 9 arranged on the top of the insulating bodies 2 and 5.

According to this variant, the protection insulating part 9 includes over the entire height of the part 9, through holes 90 to 94 instead of peripheral cutouts 80 to 84 of the protection part 8 of FIGS. 9 to 12. Each of the through holes 90 to 94 let through the flexible ground tabs 40 to 44.

There is also a central through hole 95 which let through the flexible central tab 31. This variant allows also to mechanically protect the flexible tabs 40 to 44 and 31 in case of an unexpected mechanical effort which would be applied transversally to axis X, either during the B-to-B connection or during any kind of manipulations.

The insulating part 9 is mated by indexing and connecting pins 54 protruding on the top face of the insulating body 5 and which are accommodated into corresponding holes 96 drilled in the protection part 9. In this variant, the protection part 9 has snap hooks 97 which are protruding on the lower face of the part 9 and which serve to assemble the part 9 to the insulating body 5 by snap hooking the lower face of the part 9, as shown on FIG. 15.

Other variants and enhancements can be provided without in any way departing from the framework of the invention.

For example, if the illustrated embodiments show a number of flexible and rigid tabs for the ground contact in number of five per end of a connector, any other configuration in crown from three conductive tabs can be envisaged in so far as the space between two adjacent flexible tabs is reduced compared to the prior art in order to minimise the RF signal leaks.

The expression "comprising a" should be understood to be synonymous with "comprising at least one", unless otherwise specified.

The invention claimed is:

1. A unitary RF connector extending along a longitudinal axis (X) and comprising:

a first electrical insulating body which is rigid;

a conductive strip forming a central contact retained within the first insulating body; which comprises at, at least one of its free ends, a first tab being configured as a spring able to flex toward one of the end face of the insulating body taking any closer position when acted upon by a pressure force of a complementary connection element;

a ground contact comprising a conductive body which is closed on itself and retained around the insulating body and, at, at least one of the free end of said conductive body, at least three second conductive tabs, each second conductive tab comprising a single unfolded segment, extending oblique relative to and towards the outside of the conductive body, each second conductive tab being configured as a spring able to flex toward the conductive body taking any closer position when acted upon by the pressure force of the complementary connection element, the at least three second conductive tabs being arranged in a crown shape, around the conductive body.

2. The unitary RF connector according to claim 1, comprising a second electrical insulating body surrounding at least partially the conductive body while being retained around this latter.

3. The unitary RF connector according to claim 1, wherein the second insulating body comprises at least one pillar and which height being determined to protect the second tabs against the over flexion.

4. The unitary RF connector according to claim 2, comprising a protection insulating part which is arranged and maintained on the top of the second insulating body, said protection insulating part comprising peripheral cutouts or through holes over the entire height of the part and a central through hole which let through respectively the flexible ground tabs and the flexible central tab.

5. The unitary RF connector according to claim 4, comprising individual supports which are protruding from the top face of the second insulating body, beneath each flexible ground and central tabs.

6. The unitary RF connector according to claim 4, wherein the second insulating body comprises pins which are protruding from its top and which serve to guide the protection part above the insulating body.

7. The unitary RF connector according to claim 4, wherein the height of the protection part or of the pins is such that it protects each flexible ground and central tabs.

8. The unitary RF connector according to claim 1, wherein the cross-section, transversely to the longitudinal axis (X), of the first electrical insulating body and of the conductive body of the ground contact is a regular pentagon, said ground contact comprising five second conductive tabs arranged in a crown shape, each of the second conductive tab extending from a side of the pentagonal conductive body.

9. The unitary RF connector according to claim 1, wherein both free ends of each of the ground and the central contacts are each configured as a spring forming the first and second conductive tabs intended to come into electrical contact by the pressure force with a conductive track of one of a first printed circuit and a second printed circuit.

10. The unitary RF connector according to claim 1, wherein only one free end of each of the ground and the central contacts is configured as a spring forming the first and second conductive tabs intended to come into electrical contact by the pressure force with a conductive track of a first printed circuit board, while the other one free end of each of the ground and the central contacts is rigid forming the first and second conductive tabs intended to be soldered to a conductive track of a second printed circuit board.

11. The unitary RF connector according to claim 1, wherein the central contact is formed by a metal strip that is curved at each of its ends, said curved ends constituting the first conductive tabs.

12. The unitary RF connector according to claim 1, wherein the ground contact is made as a single piece by being cut out from a metal sheet and being rolled up.

13. The unitary RF connector according to claim 1, wherein the first insulating body is overmolded on the central contact and the ground contact is assembled around the insulating body.

14. The unitary RF connector according to claim 2, wherein the second insulating body is overmolded or assembled around the ground contact.

15. A connection module, intended to be used to link two printed circuit boards comprising at least one unitary RF connector according to claim 1.

16. The connection module according to claim 15, comprising at least a stack of two identical unitary RF connectors wherein each of the flexible tabs of the central contact and of the flexible tabs of the ground contact of one connector is in flexible contact with a corresponding flexible tab of the other connector.

17. The connection module according to claim 15, comprising at least one holder comprising a frame closed on itself with at least one opening in which each unitary connector is accommodated according to a floating mounting.

18. The connection module according to claim 17, wherein the second insulating body of each connector is directly floating mounted into the holder.

19. Use of the unitary RF connector according to claim 1, to transmit RF (radiofrequency) signals or HSDL (High Speed Data Link) signals.

* * * * *